United States Patent [19]

Daumas et al.

[11] Patent Number: 5,039,355

[45] Date of Patent: Aug. 13, 1991

[54] PROCESS FOR OBTAINING PARTS MADE OF COPPER OF VERY FINE TEXTURE FROM A BILLET MADE BY CONTINUOUS CASTING

[76] Inventors: Marie T. Daumas, Orsay; Jean Collard, Gif sur Yvette; Gérard Tost, Landremont, all of France

[21] Appl. No.: 497,007

[22] Filed: Mar. 20, 1990

[30] Foreign Application Priority Data

Mar. 22, 1989 [FR] France ..... 89 03751

[51] Int. Cl.[5] ..... B21K 21/10; C22F 1/08

[52] U.S. Cl. ..... 148/11.5 C; 148/132; 148/153

[58] Field of Search ..... 148/11.5 C, 13.2, 153, 148/155

[56] References Cited

U.S. PATENT DOCUMENTS

| | | | |
|---|---|---|---|
| 2,312,830 | 3/1943 | Eldred | 148/11.5 C |
| 3,464,865 | 9/1969 | Eichelman | 148/11.5 C |
| 3,465,567 | 9/1969 | Park | 148/11.5 C |
| 3,882,712 | 5/1975 | Shapiro et al. | 148/11.5 C |
| 4,047,978 | 9/1977 | Parikh et al. | 148/11.5 C |
| 4,537,242 | 8/1985 | Pryor et al. | 148/2 |
| 4,599,119 | 7/1986 | Ikushima et al. | 148/11.5 C |
| 4,799,973 | 1/1989 | Madhukar et al. | 148/11.5 C |

FOREIGN PATENT DOCUMENTS

| | | |
|---|---|---|
| 2358554 | 8/1974 | Fed. Rep. of Germany . |
| DE35156-36A1 | 6/1986 | Fed. Rep. of Germany . |
| 792240 | 12/1935 | France . |
| 2443044 | 6/1980 | France . |
| 2599648 | 12/1987 | France . |

*Primary Examiner*—Upendra Roy

*Attorney, Agent, or Firm*—Kerkam, Stowell, Kondracki & Clarke

[57] ABSTRACT

The process according to the invention makes it possible to form parts from copper of high purity and fine structure.

Beginning with a billet (1) made by continuous casting, it includes the following main phases:

- a kneading of the billet (1, 4) comprising upsetting and drawing cycles;
- cutting of the billet into blanks (8) each intended to form one finished part;
- an operation of die forging (9, 12) at ambient temperature; and
- a recrystallization heat treatment to obtain a grain size of the copper of less than 40 micrometers.

The invention is applicable to the production of internal liners for shaped charges.

8 Claims, 2 Drawing Sheets

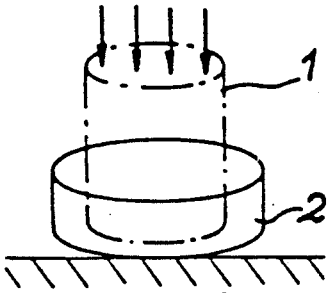
FIG. 1A
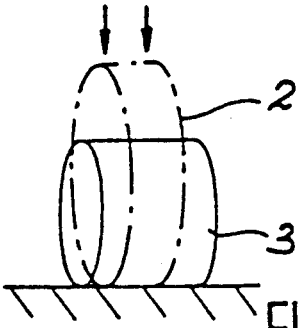
FIG. 1B
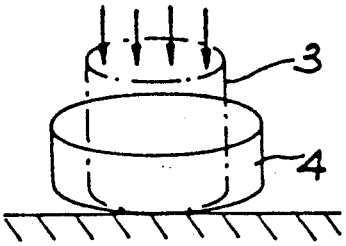
FIG. 1C
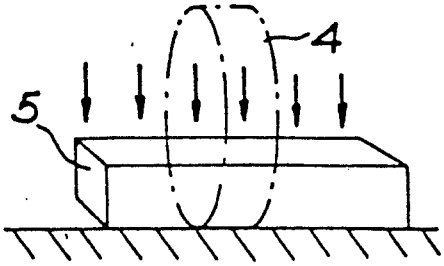
FIG. 1D
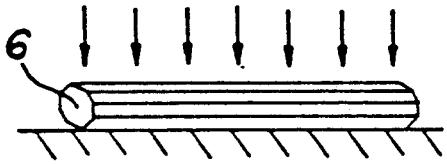
FIG. 1E
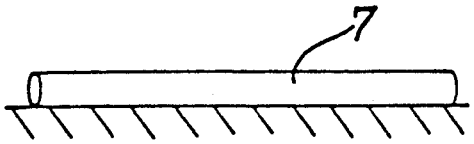
FIG. 1F
FIG. 1G
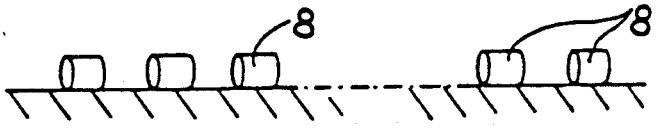
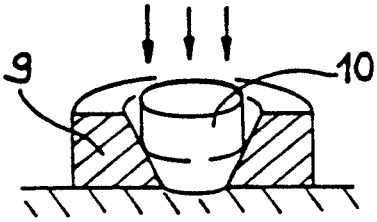
FIG. 1H
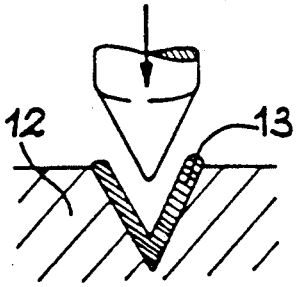
FIG. 1I

PROCESS FOR OBTAINING PARTS MADE OF COPPER OF VERY FINE TEXTURE FROM A BILLET MADE BY CONTINUOUS CASTING

BACKGROUND OF THE INVENTION

The invention relates to the working and forming of parts made of copper of very high purity, and in particular parts such as liners for shaped charges.

DESCRIPTION OF THE PRIOR ART

There is a need to make parts of average and large size from copper of high purity that not only have symmetry in terms of geometry but also symmetry in terms of the internal stresses. Some of these parts are generated by revolution about an axis of symmetry. This axis may also be an axis of symmetry in terms of the function of the apparatus to which the manufactured part belongs.

Such is the case for conical liners for shaped charges. These liners are brought to a very high temperature, within a period of time on the order of a microsecond, and ejected at very high speed in the form of a jet. The part must therefore have perfect static and dynamic equilibrium.

At present, shaped charge liners are produced industrially from blanks in the form of a flat disk by a process of flow turning, comprising cold plastic deformation on a mandrel, to turn the sheet-metal disk into a cone. The blank for the part is placed on a high-powered flow turning lathe. Various passes make it possible to deform the part without removing material. In the various changes of shape, the metal retains the memory of its various deformations under the influence of the wheel of the flow turning lathe. In that case, the resultant parts are not in a state of symmetrical stress with respect to the axis of revolution.

SUMMARY OF THE INVENTION

The object of the present invention is to overcome this disadvantage and to propose a process for production capable of being implemented and applied to the manufacture of copper parts involved in the construction of shaped charges.

To this end, the primary subject of the invention is a process for producing copper parts, in particular for making liners for shaped charges, in which the grain size is less than 40 micrometers.

According to the invention, it comprises beginning with a billet made by continuous casting and includes successively:

a kneading cycle including the following steps:

a first upsetting of the billet at an upsetting rate $R_1$ between 4.8 and 5, at a first temperature $T_1$ between 480° C. and 420° C.;

a first drawing of the billet at a rate $E_1$ between 2.1 and 2.5 and at a second temperature $T_2$ between 400° C. and 420° C.;

a second upsetting of the billet at a rate $R_2$ between 2.1 and 2.5, at the second temperature $T_2$; and a second drawing of the billet at a rate $E_2$ between 9.8 and 20.2, at the second temperature $T_2$;

a die forging operating including the following two steps:

preforging at ambient temperature, to obtain a blank with formation of a frustoconical base; and at least one die forging operation at ambient temperature with a bottom die corresponding to the shape to be obtained;

a recrystallization heat treatment.

In the case where the billet is made by continuous casting and is large in size, the process includes, after the kneading cycle, a step of cutting the billet to length to furnish the blanks, the mass of which corresponds to the mass of the parts to be obtained.

A preferable implementation of the second drawing operation provides a plurality of subphases, to obtain successively a billet of square section, then of octagonal section, and then of round section.

In another feature of the invention, the kneading is preceded by a scalping phase. Preferably, the die forging is preceded by a scalping phase.

According to the invention, in the case where conical parts are produced , the apex of the cone to be obtained is formed in the course of the last forging phase.

Preferably, the recrystallization heat treatment is performed at a temperature between 300° C. and 440° C., in a vacuum and for a period of time that varies from 30 to 60 minutes.

BRIEF DESCRIPTION OF THE DRAWING

The invention and its various technical characteristics will be better understood from reading the ensuing description. The description is accompanied by drawing figures, which respectively show:

FIGS. 1A–lI, the various phases of the production process according to the invention for making conical parts, such as liners for shaped charges;

DETAILED DESCRIPTION OF THE INVENTION

The copper parts to be obtained must have a crystalline structure the grains of which are less than 40 micrometers in size. Until now, for industrial use of copper parts, such as liners for shaped charges, the material used is in the form of ordinary metal sheets. The crystalline structure of these sheets allows flow turning, but does not allow the crystalline structure of the finished parts to be on the order of fineness mentioned above.

A particular feature of the invention comprises using a billet made from a bar produced by continuous casting.

Figure 2A:
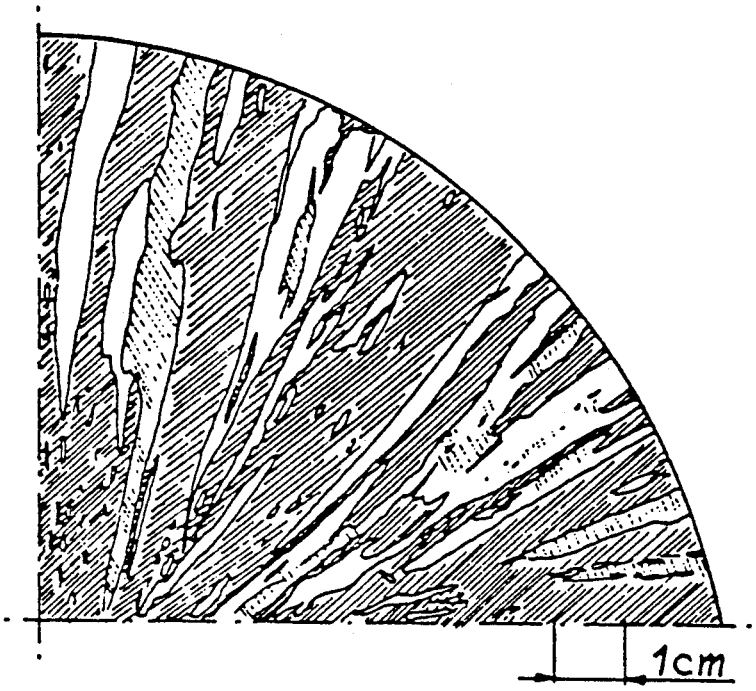
FIGS. 2A, 2B and 2C, fragmentary sectional views showing the successive structures of a part in the course of the production process according to the invention.

As FIG. 2A shows, the crystalline structure of such copper obtained by continuous casting comprises grains with basaltic growth. Their length can reach eight centimeters. They are generally oriented radially with respect to the cross section of the bar obtained by casting. This radial structure is homogeneous as a function of the radius, which is not the case of metal sheets intended to be flow turned. To permit working by die forging, the process according to the invention includes a first series of kneading phases.

In this kneading, the billet is successively upset and drawn. It will be recalled that the drawing rate is the ratio of the initial and final cross sections of the part and that the upsetting rate is the ratio of the final and initial cross sections.

In the exemplary embodiment described, the initial billet has a diameter slightly greater than 200 millimeters. By way of example, the various dimensions of the part will be specified here, to more precisely illustrate the invention and its successive phases. This is merely an exemplary embodiment; the drawing and upsetting rates cited, on the other hand, are parameters the values of which must be adhered to obtain the effectiveness of the process. To perform the kneading, the billet is preferably scalped beforehand to the diameter of 203 mm.

Turning to FIG. IA, a first upsetting phase is performed at a temperature $T_1$ between 420° C. and 480° C., preferably at the temperature of 450° C. The upsetting rate $R_1$ that must be used is between 4.8 and 5; the value of 4.9 is preferably used. In the case of the aforementioned billet, at the time of this upsetting, the diameter of the billet changes from 203 mm to 450 mm. Such upsetting can be obtained with the aid of a hydraulic press functioning with a force of 1200 tons, and the descent of the piston is 60 meters per minute or in other words one meter per second, at constant speed.

This upsetting is followed by drawing. This operation is performed at a temperature $T_2$ slightly lower than the first upsetting temperature $T_1$. In effect, the more the temperature decreases, the smaller the grain size of the treated part. Since the fineness of the grain is one object of the process according to the invention, the temperature is accordingly reduced. On the other hand, this reduction must be meticulously metered out to prevent the phenomenon of strain-hardening, which is likely to occur if there is a major drop in temperature. Consequently, the temperature $T_2$ is between 400° C. and 420° C., with the value of 400° C. corresponding to the value of 450° C. for the upsetting.

As FIG. 1B shows, at the time of this drawing phase, the billet is rocked by 90°, with its axis being horizontal. The drawing rate to be used is between 2.1 and 2.5, with the value of 2.2 being preferential. The diameter of the billet 2 is brought from 450 mm to 300 mm for this same billet now identified by reference numeral 3. The drawing operation can be performed on the same 1200 ton press, at the same constant speed of descent of the piston, in this case 60 meters per minute.

These first two steps are followed by two other similar steps.

In effect, as FIG. 1C shows, the billet 3 is rocked in such a manner that its axis is now vertical. It then undergoes a second upsetting phase, still at the second temperature $T_2$ of between 400°and 420° C. For this operation, the upsetting rate $R_2$ is between 2.1 and 2.5, with the value of 2.2 being preferential. The billet 3 is then changed into the shape of a larger billet, identified by reference numeral 4 in FIG. 1C, with its diameter in this case being 450 mm.

A second drawing operation follows the second upsetting and is performed still at the same temperature $T_2$ of between 400 and 420° C.

Turning to FIGS. 1D, 1E and 1F, the billet 4 is returned to the horizontal. It then undergoes a plurality of successive phases, in the course of which the drawing rate $E_2$ is between 19.8 and 20.2, with the value of 20 being preferably chosen.

As FIG. ID shows, the billet 4 is changed into the form of a square billet, 240 mm on a side.

As FIG. 1E shows, the drawing follows, and the square billet 5 is put into the shape of an octagonal billet 6, the sides of which are approximately 100 mm long. The drawing is completed by the transformation of the octagonal billet 6 into an elongated cylindrical billet 7, of 100 mm in diameter (FIG. 1F). This last shaping is performed by means of sizing using a drop hammer.

The billets made by continuous casting are generally quite a bit larger than the size of the manufactured parts. In fact, one of these billets can at present exceed 100 kg and may have a length on the order of 500 mm. Hence this billet must be cut to length at the end of the final kneading phase, once the billet has been drawn sufficiently for this purpose. Blanks 8 are then cut to length, having a mass equal to the mass of the part that is to be produced. The cutting to length is schematically shown in FIG. 1G.

The second principal part of the process according to the invention comprises die forging beginning with the part made after the final finishing operation. The preparation of the billet can also be completed with scalping to the diameter of 95 mm. This is followed by a preforging phase at ambient temperature, during which the diameter of the part increases, to assume the value of 145 mm, for example.

Turning to FIG. 1H, at the time of this preforging, the part 10 undergoes forging in a conical die 9. The frustoconical base 11 obtained is intended to assure the definitive placement of the part in the forging tool. The drop in temperature brings about the reduction in the size of the grains of the crystalline structure of the billet.

In fact, as shown in FIG. 1I, the forging per se includes at least one phase of forging at ambient temperature in a die 12, the shape of which corresponds to the final shape to be obtained. The number of forging phases depends on the final dimensions to be obtained. In the context of manufacture of conical parts, the final forging phases includes the formation of the apex 14 of the cone of the part 12 to be forged.

The third principal part of the process according to the invention comprises recrystallization heat treatment. In fact, at the end of forging, after the various kneading operations, during which the cumulative kneading rate may reach 500, the grains are deformed by strain-hardening in the entire part and in the direction of the metal flow.

Figure 2B:
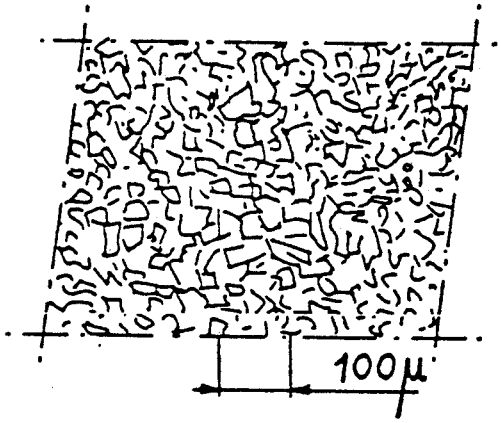

FIG. 2B shows a detail of a section taken in the billet at the end of the forging, once the shaping of the part has been completed. Taking the scale into account, symbolized by representation of 100 $\mu$m/1 cm, it can be confirmed that the grain size has decreased considerably, now having a size on the order of 50 $\mu$m.

For the present case, the heat treatment preferably comprises a heat treatment in a vacuum at the temperature $T_3$ of 440° C. Generally, this third temperature $T_3$ is between 300° C. and 440° C. This operation is performed for a period of time of between 30 and 60 minutes. Following this heat treatment, the final grain size of the copper is less than 40 micrometers. For the application that has just been described, this size is between 10 and 30 micrometers.

Figure 2C:
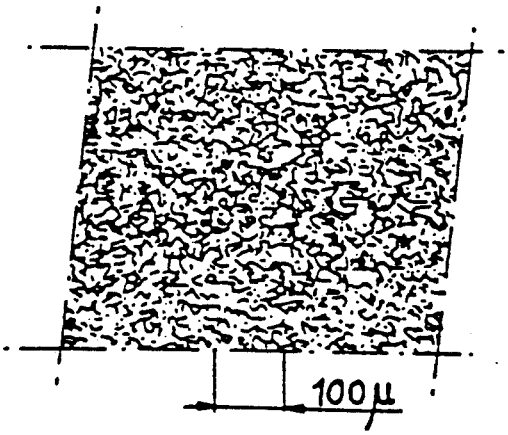

FIG. 2C, on a scale of 100, shows the crystalline structure of the completed part. The grain size has decreased further and is on the order of about 10 micrometers.

In the context of the application of the process to the production of conical inner liners for shaped charges, the process can be completed with a finishing phase. This may be performed by flow turning, once the metallurgical structure obtained after the recrystallization heat treatment is stabilized. This arrangement makes it possible to benefit from the advantages on the one hand of the final metallic structure obtained by the kneading followed by forging and then recrystallization, and on the other hand of the finishing obtained by a final flow turning phase.

We claim:

1. A process for producing parts from continuously cast copper billet (1), in particular lines for shaped charges having grain size less than 40 micrometers and having symmetry in terms of internal stresses comprising the steps of:

kneading including a first upsetting of the billet (1) at an upsetting rate $R_1$ between 4.8 and 5, at a first temperature $T_1$ between 480° C. and 420° C.;

a first drawing of the billet (2) at a rate $E_1$ between 2.1 and 2.5 and at a second temperature $T_2$ between 400° C. and 420° C.;

a second upsetting of the billet (3) at a rate $R_2$ between 2.1 and 2.5, at the second temperature $T_2$; and a second drawing of the billet (4) at a rate $E_2$ between 19.8 and 20.2, at the second temperature $T_2$;

a die forging including the following two steps:

preforging (in bottom die 9) at ambient temperature, to obtain a blank (10) with formation of a frustoconical base (11); and at least one die forging operation at ambient temperature with a bottom die (12) corresponding to the shape to be obtained;

a recrystallization heat treatment.

2. The process as defined by claim 1, characterized in that it includes, after the kneading cycle, a step of cutting the billet (7) to length to furnish the blanks (8), the mass of which corresponds to the mass of the parts (13) to be obtained.

3. The process as defined by claim 1, characterized in that the second drawing is effected in several subphases, to obtain successively a billet (5) of square section (6), then of octagonal section, and then of round section (7).

4. The process as defined by claim 2, characterized in that the kneading is preceded by a phase of scalping the billet (1) made by continuous casting.

5. The process as defined by claim 3, characterized in that the forging is preceded by a scalping operation.

6. The process as defined by claim 3, in which the parts (13) to be obtained must be conical, characterized in that the apex (14) of the cone is formed in the course of the last forging phase.

7. The process as defined by one of claims, characterized in that the recrystallization heat treatment is performed in a vacuum, at a temperature $T_3$ between 300° C. and 440° C. and for a period of time of between 30 and 60 minutes.

8. The process as defined by claims, characterized in that it is terminated with a step of finishing by flow turning.

* * * * *